US007563000B2

(12) United States Patent
Gierveld

(10) Patent No.: US 7,563,000 B2
(45) Date of Patent: Jul. 21, 2009

(54) DISPLAY ASSEMBLY AND METHOD FOR ITS APPLICATION

(75) Inventor: Johan Gierveld, Nijverdal (NL)

(73) Assignee: Clear Trading B.V., Wierden (NL)

( * ) Notice: Subject to any disclaimer, the term of this patent is extended or adjusted under 35 U.S.C. 154(b) by 220 days.

(21) Appl. No.: 11/398,566

(22) Filed: Apr. 6, 2006

(65) Prior Publication Data

US 2006/0254100 A1 Nov. 16, 2006

(30) Foreign Application Priority Data

Apr. 6, 2005 (NL) ..... 1028708
Jan. 25, 2006 (NL) ..... 1030995

(51) Int. Cl.
*F21L 14/00* (2006.01)

(52) U.S. Cl. ..... 362/249; 362/806; 362/431

(58) Field of Classification Search ..... 362/249, 362/431, 806, 250, 252, 388; 248/218.4, 248/534; 211/196, 205; 428/9, 18, 20
See application file for complete search history.

(56) References Cited

U.S. PATENT DOCUMENTS 3,677,867 A * 7/1972 Westlund ..... 428/9
3,808,082 A 4/1974 Steiber
5,336,536 A * 8/1994 Oberzan ..... 428/8
5,405,662 A 4/1995 Oberzan et al.
5,486,386 A 1/1996 Rovsek et al.
5,740,822 A 4/1998 Einck et al.
6,062,701 A 5/2000 Hines et al.
6,224,231 B1 5/2001 Personius
6,334,694 B1 1/2002 Huang
6,663,921 B1 12/2003 Quigel
7,080,925 B1 * 7/2006 Rushing ..... 362/249

FOREIGN PATENT DOCUMENTS

DE 2102359 A1 8/1972

* cited by examiner

*Primary Examiner*—Sharon E Payne
(74) *Attorney, Agent, or Firm*—Birch, Stewart, Kolasch & Birch LLP

(57) ABSTRACT

An assembly including a mast dressing device that can be fastened to the mast, and a peripheral element or a series of mutually connected peripheral elements suspended from a top part of the mast. The dressing device is adapted to be hoisted by the mast, such that one peripheral element of the dressing device extends spirally around the mast, and/or a series of peripheral elements which are mutually connected by connecting elements are positioned in the vertical direction at a distance from each other.

20 Claims, 12 Drawing Sheets

DISPLAY ASSEMBLY AND METHOD FOR ITS APPLICATION

BACKGROUND OF THE INVENTION

The present invention relates to an assembly of a mast and a dressing device to be fastened to this mast. The invention also relates in particular to such an assembly, comprising a flagpole and a dressing device.

Flagpoles are known. As a rule, these are vertically raised poles having, near an upper part, suspension means for a flag. To that end, a rope may be provided through or along the mast, which is guided with the aid of a pulley or eyelet so that a flag attached to the rope can be hoisted and lowered. However, for large periods of time, a very large number of flagpoles stand unused.

It is further known to set up decorative devices such as seasonal decorations, advertising elements and the like, for instance Christmas trees, illuminations of trees and houses and the like.

SUMMARY OF THE INVENTION

The object of the invention is an assembly with which a new use of a mast such as a flagpole is made possible. To that end, an assembly according to the invention comprises a mast and a device to be fastened to the mast, wherein the device comprises a dressing device which comprises a peripheral element or a series of mutually connected peripheral elements and is suspended from a top part of the said mast.

With such an assembly, a dressing device is suspended from a mast such as a flagpole, in particular adjacent a top end. It is preferred that here, use is made of means already present for, for instance, suspending a flag, such as the above-mentioned rope.

In a first embodiment, the dressing device comprises a peripheral element extending for instance spirally around the mast. Connecting elements can be provided which connect, at a distance from each other, the peripheral element to itself, in particular windings thereof.

In a second embodiment, a series of peripheral elements are provided arranged one above the other and preferably mutually connected by connecting elements.

The connecting elements of the different embodiments can for instance be bands, cables, wires or slats. However, it is preferred that they be somewhat flexible so that the dressing device can be folded in when it is removed from the mast. Over and/or under the or each peripheral element and optional connecting elements, a dressing can be provided, for instance from plastic.

In a particularly advantageous embodiment, the peripheral elements are elements closed upon themselves, for instance circular or multi-angular. The peripheral elements can be solid, closed elements but are preferably built-up from annular elements with a central opening around the mast. Optionally, spokes can be provided reaching adjacent or against the mast. Here, they can be connected to a connecting element which extends around the mast and secures the respective peripheral element at least substantially horizontally relative to the mast.

In an advantageous embodiment, the peripheral elements are designed such that they fit together in a nesting manner if they are removed from the mast such that they can be compactly stored. The peripheral elements may also be designed such that they can be folded in and be brought into a substantially flat, upright position. They, too, can then simply be stored and furthermore simply be provided around the mast.

To that end, the or each peripheral element can be provided in the circumference with one connection which can be detached, for instance by a clamping fastener or through form-locking.

In a particularly advantageous embodiment, illumination elements are provided, for instance on and/or onto and/or in a number of peripheral elements and/or connecting elements and/or a dressing. As a result, a particularly pleasant appearance is obtained, wherein the peripheral element or the peripheral elements together offer the advantage that in a simple manner, a pleasant design can be obtained.

Further, decorations can be provided on, in and/or onto a number of peripheral elements and/or connecting elements and/or a dressing. As a result of this too, a particularly pleasant appearance is obtained.

It is preferred that the dressing device is connected to the mast in a suitable manner, such that undesired movements are prevented. That is why it is preferred that a fastening device be provided with which the dressing device is secured to the mast at a distance from the upper part of the mast. This fastening device is preferably designed such that rotation of at least a part of the dressing device around the mast is possible while it preferably prevents horizontal and/or vertical movements. For instance, an annular fastening element can be provided which is fastened against the mast while a second, annular element can rotate therearound whereby vertical and horizontal movements are consequently prevented, as in a ball bearing or roller bearing. It is possible that only one fastening device is provided adjacent a bottom end of the dressing device but also, a series of fastening elements can be provided, for instance two or three or more, for instance one for each peripheral element. The or each fastening device is preferably divisible, such that it can be fastened around the mast in a simple manner.

The invention further relates to a dressing device for use in an assembly according to the invention. Preferably, such an assembly comprises a peripheral element or a series of peripheral elements mutually connected by connecting elements, as well as means for suspending the dressing device from a top end of a mast.

The invention furthermore relates to a method for dressing a mast, wherein a dressing device is hoisted into the mast such that one peripheral element of the dressing device extends spirally around the mast, and/or a series of peripheral elements mutually connected by connecting elements are located in vertical direction at a distance from each other.

This method can be utilized for all sorts of fields of activity, such as publicity purposes, decorations, information services and other fields.

It is noted that there are various publications that suggest an illuminated Christmas tree. Examples thereof are U.S. Pat. Nos. 5,405,662, 6,663,921, 6,334,694, 5,486,386, 5,405,662 and 6,062,701. However, most of these publications are unsuitable for fitting to a mast already anchored in the ground or the wall, such as a flagpole. The known device is either suspended from a ceiling or is itself provided with its own mast which is erected together with the device suggesting a Christmas tree. With the known devices, moreover, the suggestion of the Christmas tree is fairly poor, as the illumination is not positioned such that with it, branches of a Christmas tree are suggested. The zigzag suspension of the strands of lights described hereinbelow with reference to an exemplary embodiment does indeed provide such a Christmas tree branch impression.

BRIEF DESCRIPTION OF THE DRAWINGS

In clarification of the invention, embodiments of an assembly, dressing device and method according to the invention will be further elucidated with reference to the drawings herein.

The embodiments shown are merely shown by way of illustration and should not be construed to be limitative in any manner. Many variations thereon, among which all combinations of parts of the embodiments shown, are understood to also have been rendered herein.

DETAILED DESCRIPTION OF THE INVENTION

Figure 1:
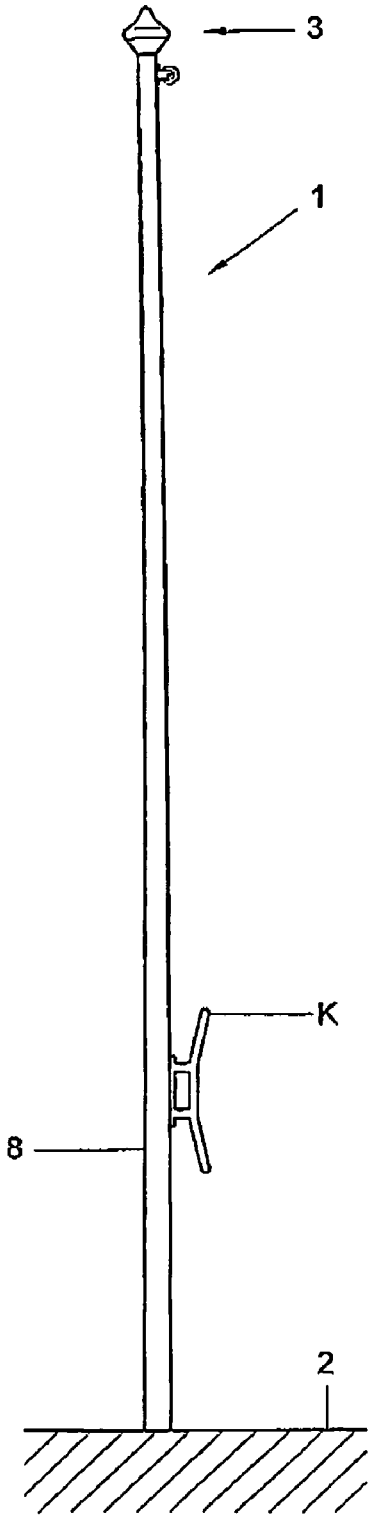
FIG. 1 shows, in side view, a mast in the shape of a flagpole.
Figure 2:
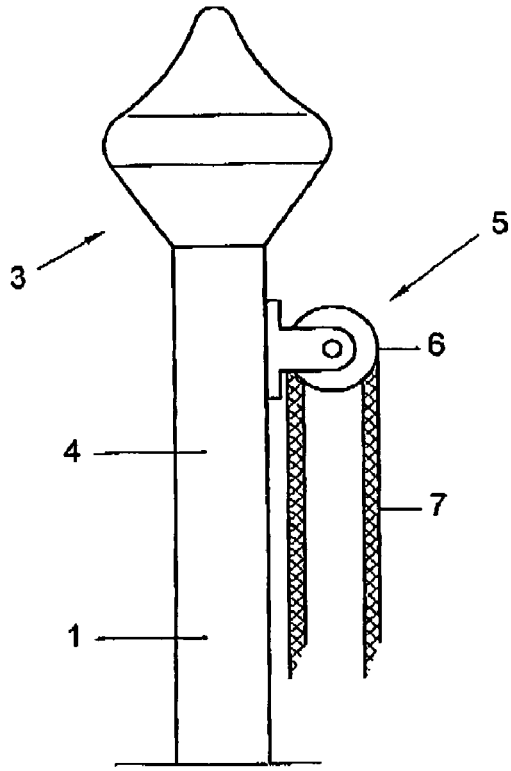
FIG. 2 shows a top end of the mast according to FIG. 1.

FIG. 1 shows a mast 1, arranged in vertical position in the ground 2. Adjacent the top end 3, at least in a top part 4, the mast is provided with a guiding element 5, for instance a pulley 6 as shown in FIG. 2, over which a rope 7 is guided, for instance a rope 7 with which, as a rule, a flag can be hoisted in the mast. The rope may be guided entirely outside the mast 1 but can also extend partly through the mast, so that, with the flag hoisted, the rope cannot be reached in a bottom part 8 of the mast 1 other than after opening of a hatch (not shown). In the exemplary embodiment shown, on the bottom part 8, a cleat K is provided to which the rope 7 can be secured.

Figure 3:
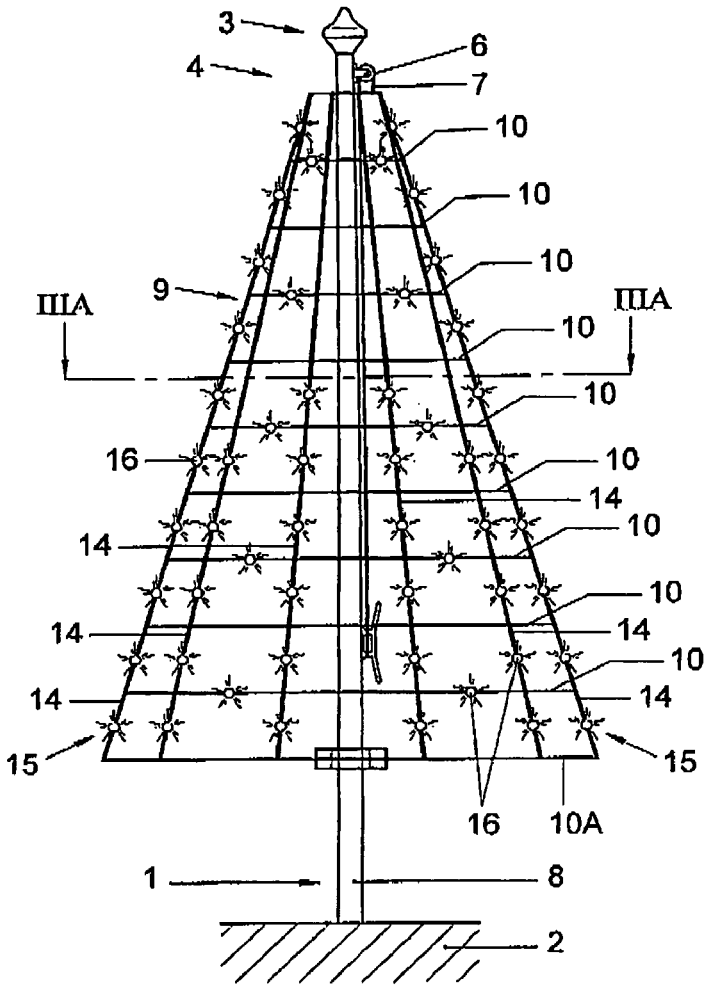
FIG. 3 shows an assembly according to the invention, in a first embodiment, comprising a mast and a dressing device.
Figure 3A:
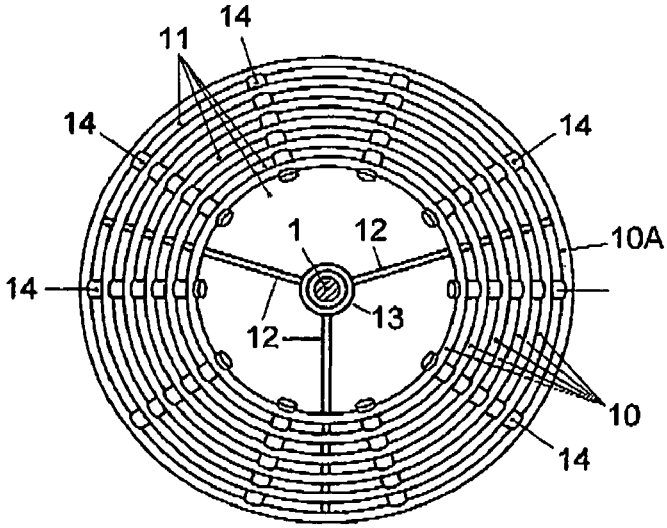
FIG. 3A shows a cross-sectional view along the line IIIA-IIIA in FIG. 3.
Figure 10:
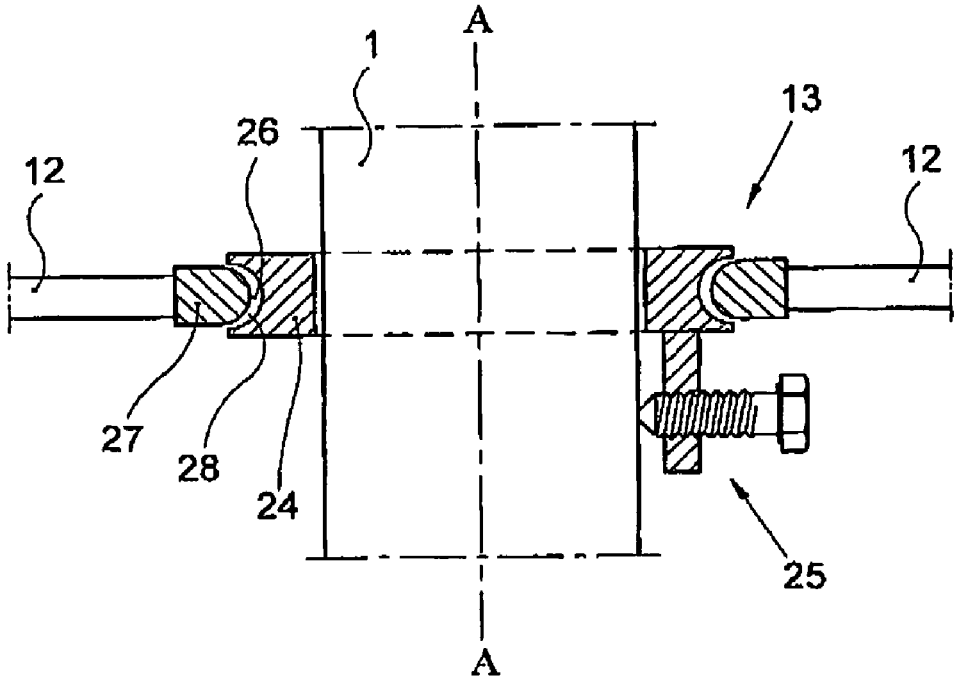
FIG. 10 schematically shows, in cross-sectional side view, a fastening device according to the invention.

In FIG. 3, a dressing device 9 is shown, suspended from the rope 7, at least from the mast 1. The dressing device 9 has a three-dimensional shape, in this embodiment substantially built up from a series of peripheral elements 10 in the form of substantially flat, annular elements as shown in FIG. 3A. In this embodiment, the peripheral elements 10 are designed such that each peripheral element has a central opening 11 in which a peripheral element, overlying in the series, fits. As a result, all annular peripheral elements 10 can be stored in a nesting manner, so that the dressing device 9 can be compactly stored. The lower peripheral element 10A has a number of spokes 12 which extend radially and are connected to a fastening device 13, for instance a sliding ring that fits around the pole 1 and can be secured thereto. Optionally, this can also be designed in a different manner, for instance as shown in FIG. 10. The purpose of the fastening device is that the dressing device will not move horizontally, at least not to an undesired extent due to, for instance, wind.

In the embodiment shown, connecting elements 14 are provided between the different peripheral elements, so that during use, the peripheral elements 10 are held at a mutual distance from each other, and can hang from the mast 1. As shown, the peripheral elements are held horizontally but they can, naturally, also be brought at an angle through the use of different lengths of connecting elements between the peripheral elements at different positions. In the embodiment shown, the connecting elements 14 are designed as bands, strips of a flexible material, but they can also be relatively rigid elements, connected or not connected to the peripheral elements 10.

The dressing device 9 is provided with illumination 15, for instance individual lights 16 on the connecting elements 14 and/or the peripheral elements 10. However, the illumination can also be designed in a different manner, for instance strands of lights or strips of chemical illumination. Also, rows of Light Emitting Diodes (LED's) can be provided or a net with lights. The illumination can also be provided in the peripheral elements and/or in the connecting elements, for instance by designing the peripheral elements to be transparent, with the lights or LED's therein. Many illumination variants will be directly clear to the person skilled in the art. In FIG. 3, the dressing device is designed as a Christmas tree. Further illuminations such as bulbs and the like can simply be suspended from the dressing device.

Figure 6:
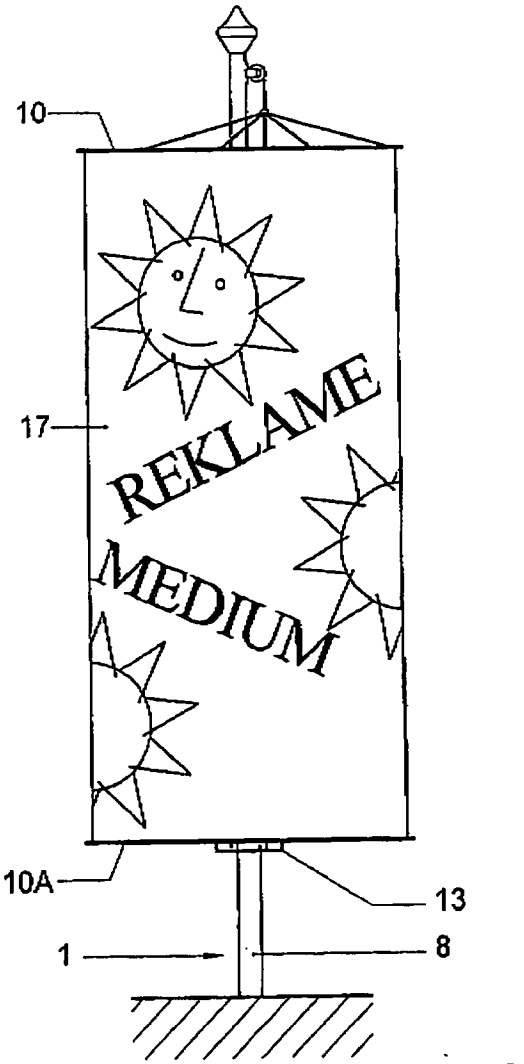
FIG. 6 shows, in side view, an assembly according to the invention, in a fourth embodiment.
Figure 5:
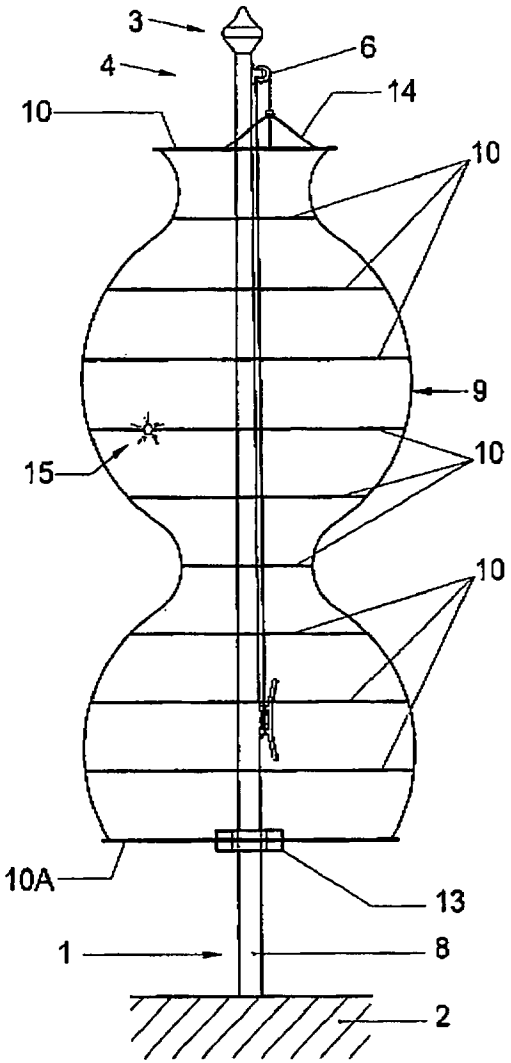
FIG. 5 shows, in partly cross-sectional side view, an assembly according to the invention, in a third embodiment.
Figure 4:
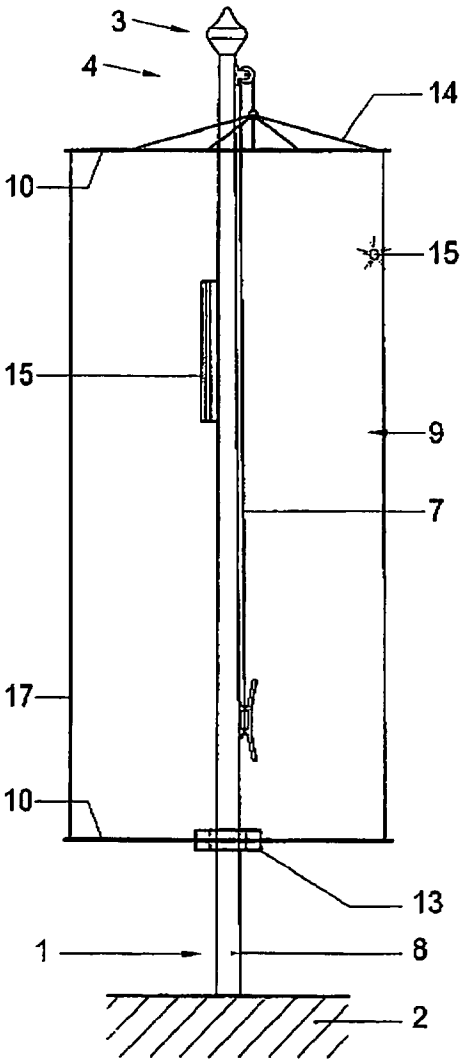
FIG. 4 shows, in partly cross-sectional side view, an assembly according to the invention, in a second embodiment.

FIG. 6 shows an assembly according to the invention, according to the embodiment shown in FIG. 4, used as an advertising element. Here, advertising visible on the outside of the dressing has been provided. Again, illumination 15 can be provided.

Figure 7:
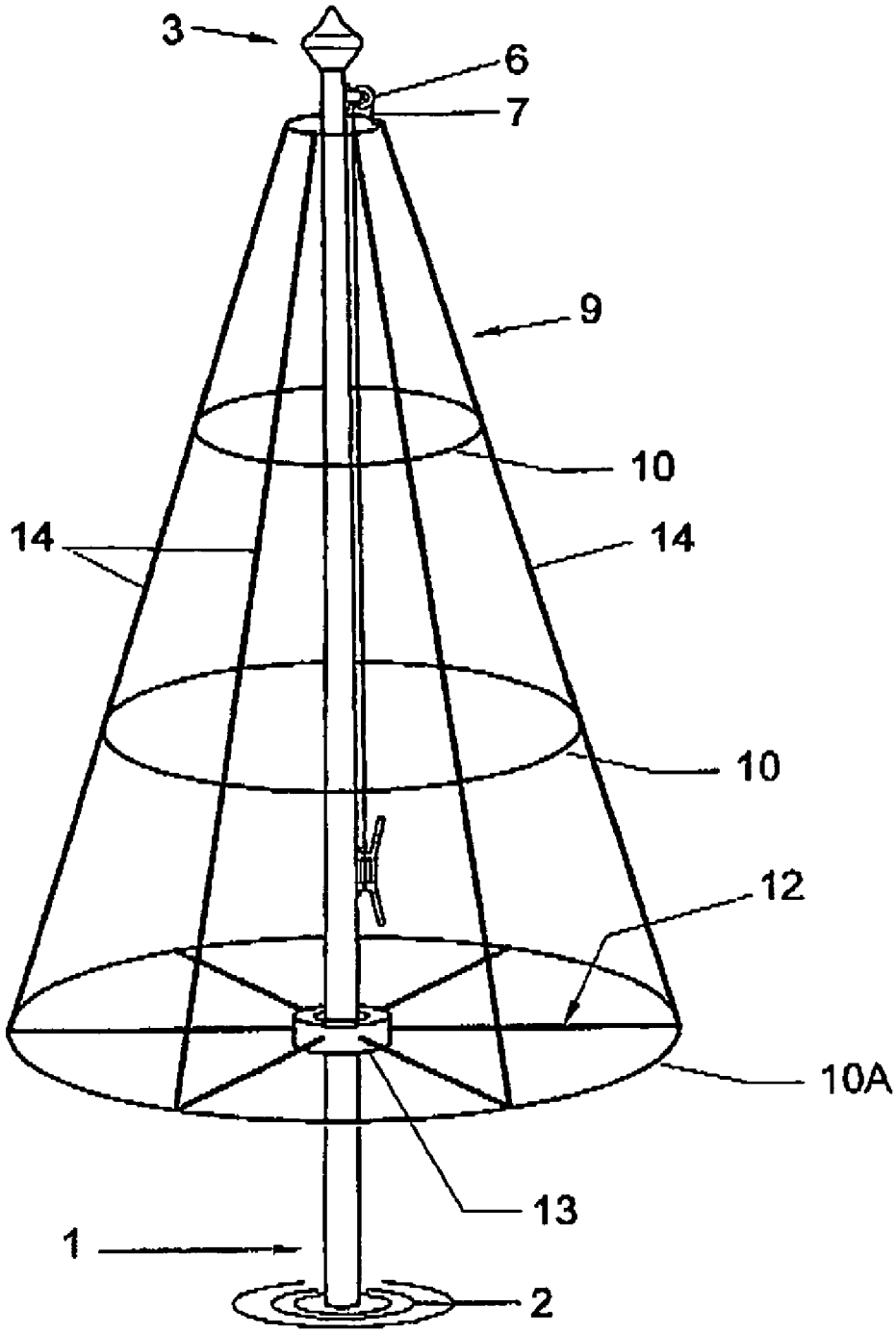
FIG. 7 schematically shows, in perspective view, an assembly according to the invention.

FIG. 7 schematically shows, in perspective view, an assembly according to the invention, with a substantially conical dressing element 9. In this embodiment, three peripheral elements 10 are provided, the bottom one having spokes 12 which are connected to a fastening element 13.

Figure 8:
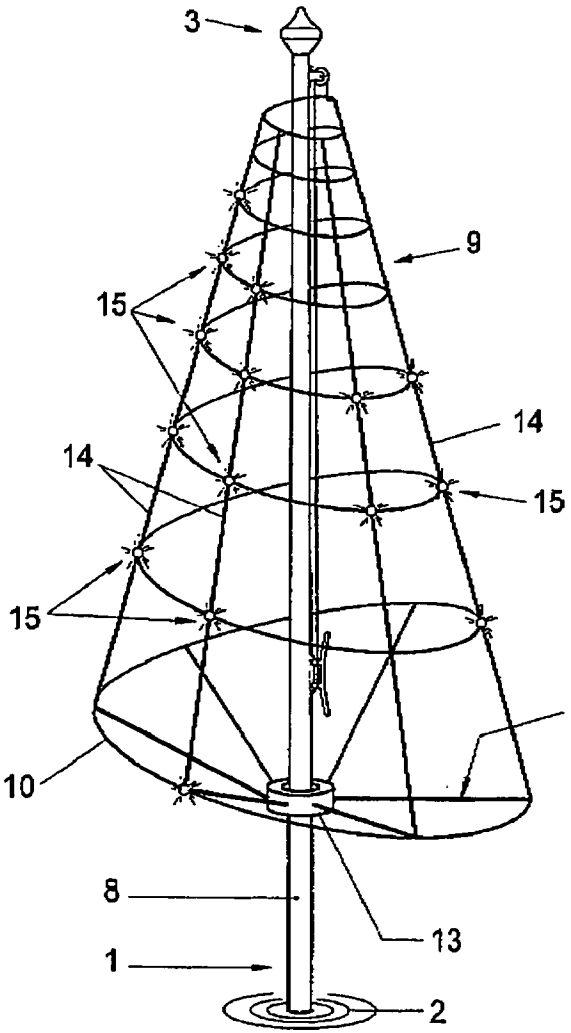
FIG. 8 schematically shows, in perspective view, an assembly according to the invention; in a fifth embodiment.

FIG. 8 shows, in perspective view, a further alternative embodiment of an assembly according to the invention, wherein one peripheral element 19 is provided extending spirally from the top end 3 of the mast 1 to a bottom end 8 and, in doing so, extending further and further away from the mast 1 so that a substantially conical shape is obtained. Connecting elements 14 extend along the outside and connect different parts of the peripheral element 10, so that a desired pitch is obtained. Adjacent the bottom side, spokes 12 are provided and a fastening element 13, whereby the bottom end 18 of the peripheral element 10 is held at a desired position relative to the mast 1. A dressing can be provided, as well as illumination 15.

Figure 9:
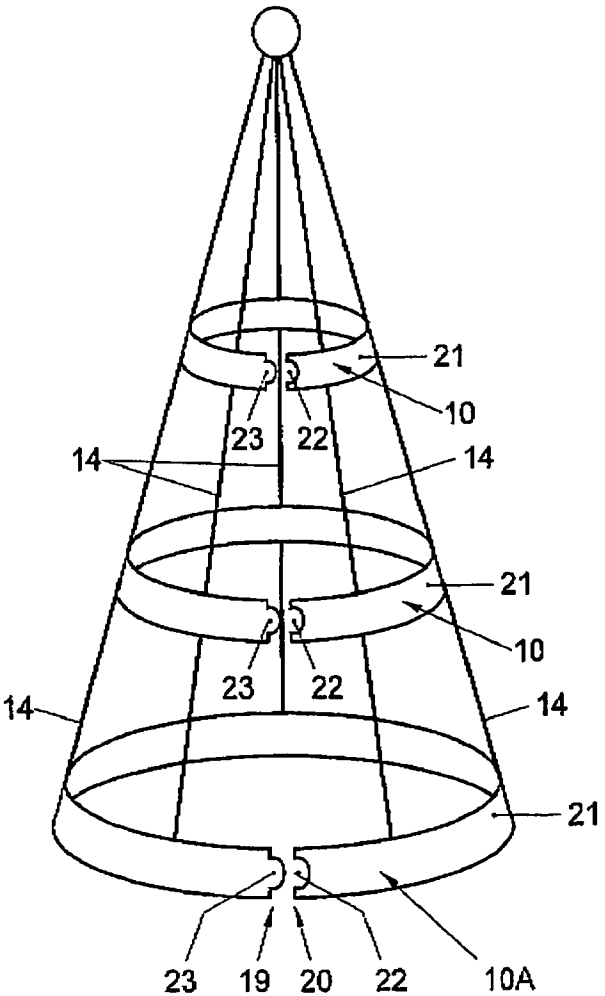
FIG. 9 schematically shows, in perspective view, an embodiment with divisible peripheral elements.

FIG. 9 schematically shows a possible design of the peripheral elements 10 for devices according to the invention. Here, each peripheral element 10 is substantially made from a strip 21 or like profile that is bent so as to form a circle. Two ends 19, 20 lying opposite each other of each strip 21 are provided with cooperating coupling means, for instance a recess 22 and a rounding 23 fitting therein. By pressing the rounding 23 into the recess 22, the ring can be closed and a peripheral element 10 closed upon itself is obtained as shown above in the different embodiments. Use of such closures offers the advantage that the peripheral elements and hence the dressing device can be provided around a mast 1 in a simple manner, or be taken therefrom without the mast 1 having to be struck. Furthermore, such a device can be manufactured relatively easily. In particular when striking the mast 1 is possible, or when the dressing device 9 can be provided over the top end 3, peripheral elements permanently closed upon themselves can suffice.

In FIG. 10 is shown, schematically and in partly cross-sectional view, a portion of a mast 1 with parts of a fastening device 13 thereon and two spokes 12. Cleary visible is an inside ring 24 which is secured against the mast 1 with the aid of a screw device 25 such that the inside ring 24 cannot shift. The inside ring is provided with a circumferential groove 26. An outside ring 27 is provided, resting with a matching profile 28 in the groove 26. As a result, the outside ring can indeed rotate around the mast, about the longitudinal axis A-A thereof, but cannot shift horizontally or vertically. If desired, the groove 26 can for instance have a larger vertical size so that the outside ring 27 can indeed move up and down over a specific pre-selected distance, but not horizontally. The spores 12 are attached to the outside ring 27. Incidentally, other fastening devices too can be used, for instance a sliding ring, if the spokes are allowed to move upwards and downwards, or for instance a pin through the mast, a screw connection, clamping means or the like for connecting at least one and preferably at least the bottom peripheral element 9 to the mast in a suitable manner.

Figure 11:
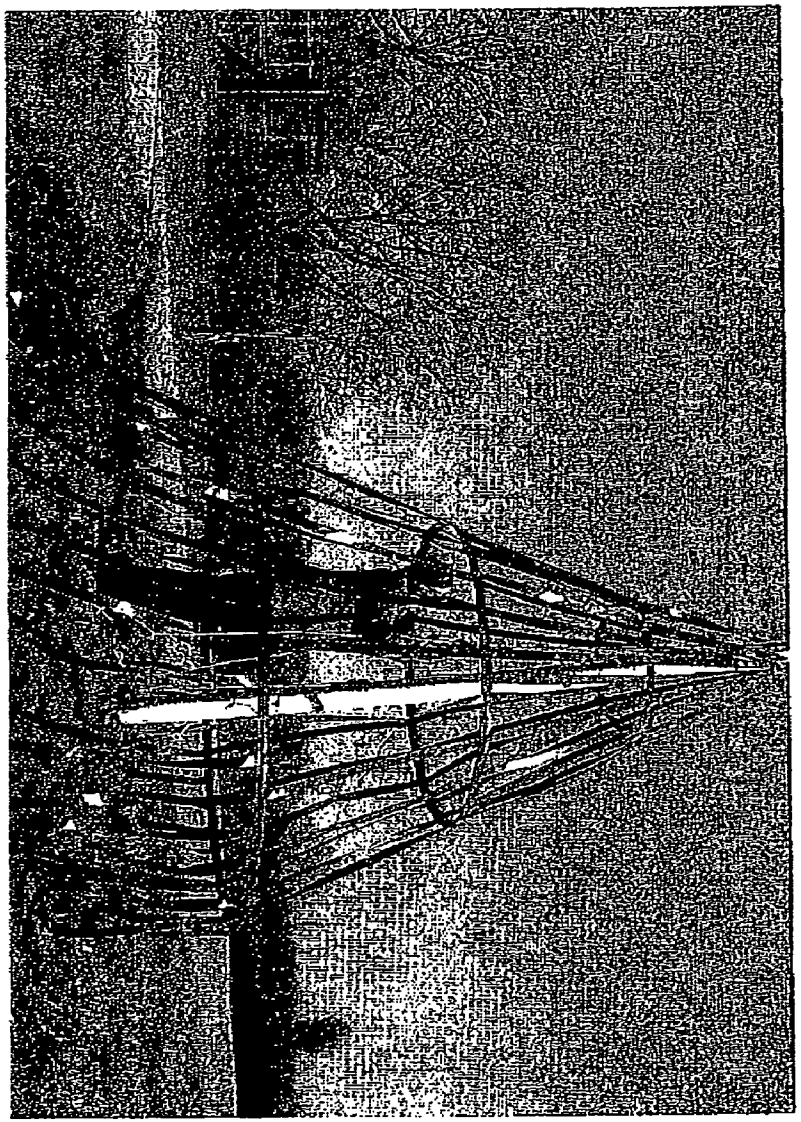
FIG. 11 shows a photograph of the hoisting of an exemplary embodiment of the device according to the invention.

FIG. 11 shows a photograph of an exemplary embodiment of the device during hoisting thereof on a flagpole. Particularly at night, the device shown in the photograph will create the impression of an illuminated Christmas tree.

Figure 12:
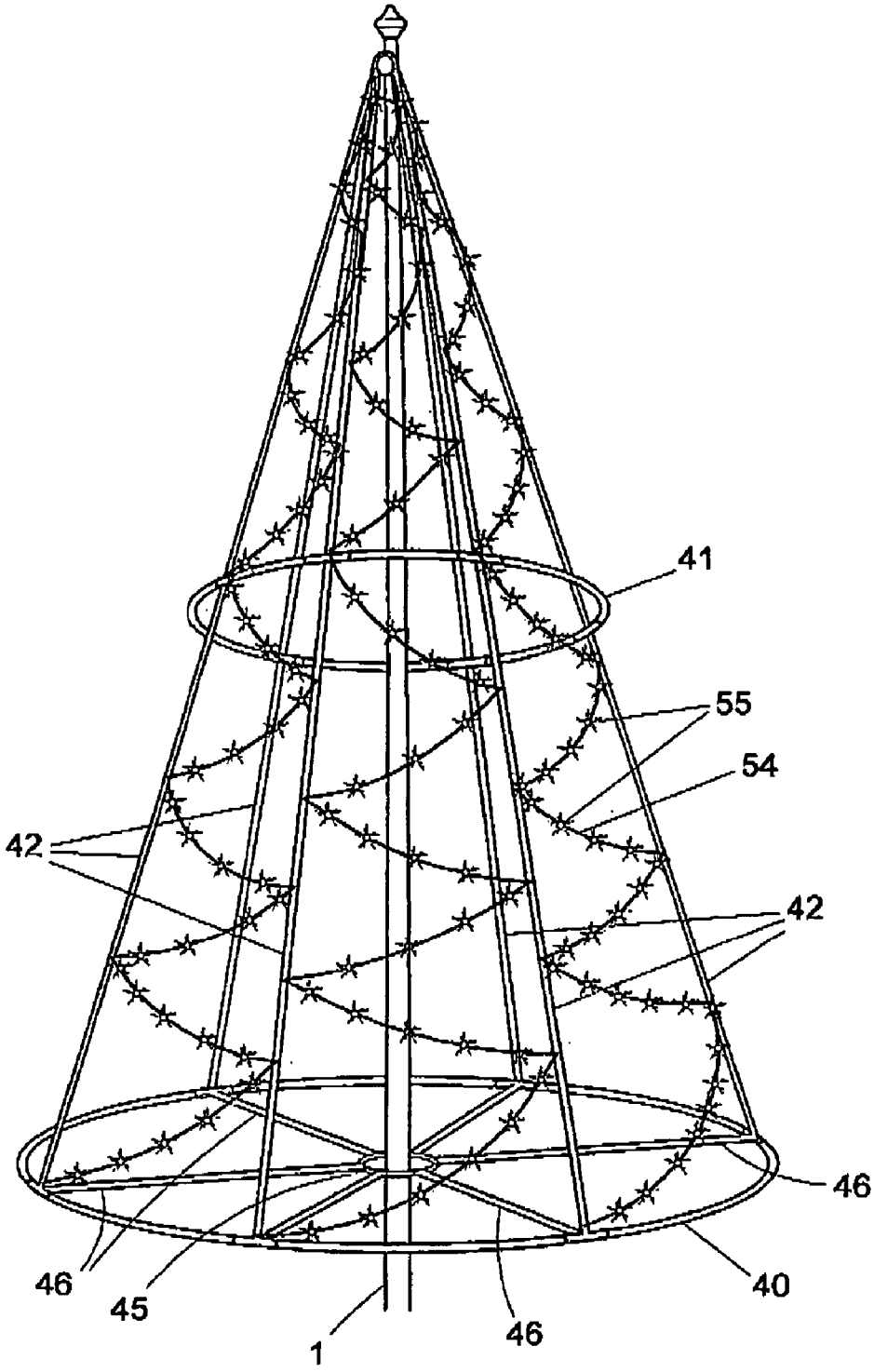
FIG. 12 shows an exemplary embodiment of a dressing device that is to form a Christmas tree-like decoration on a flagpole.

FIG. 12 shows an exemplary embodiment of a dressing device which, when it is suspended from a flagpole 1, is to represent a Christmas tree. This exemplary embodiment is built up from a minimum number of parts with a particularly low cost price. Furthermore, the exemplary embodiment can be stored and packaged particularly compactly, which is of great importance when marketing such a product with respect to minimizing the cost of transport.

Figure 13:
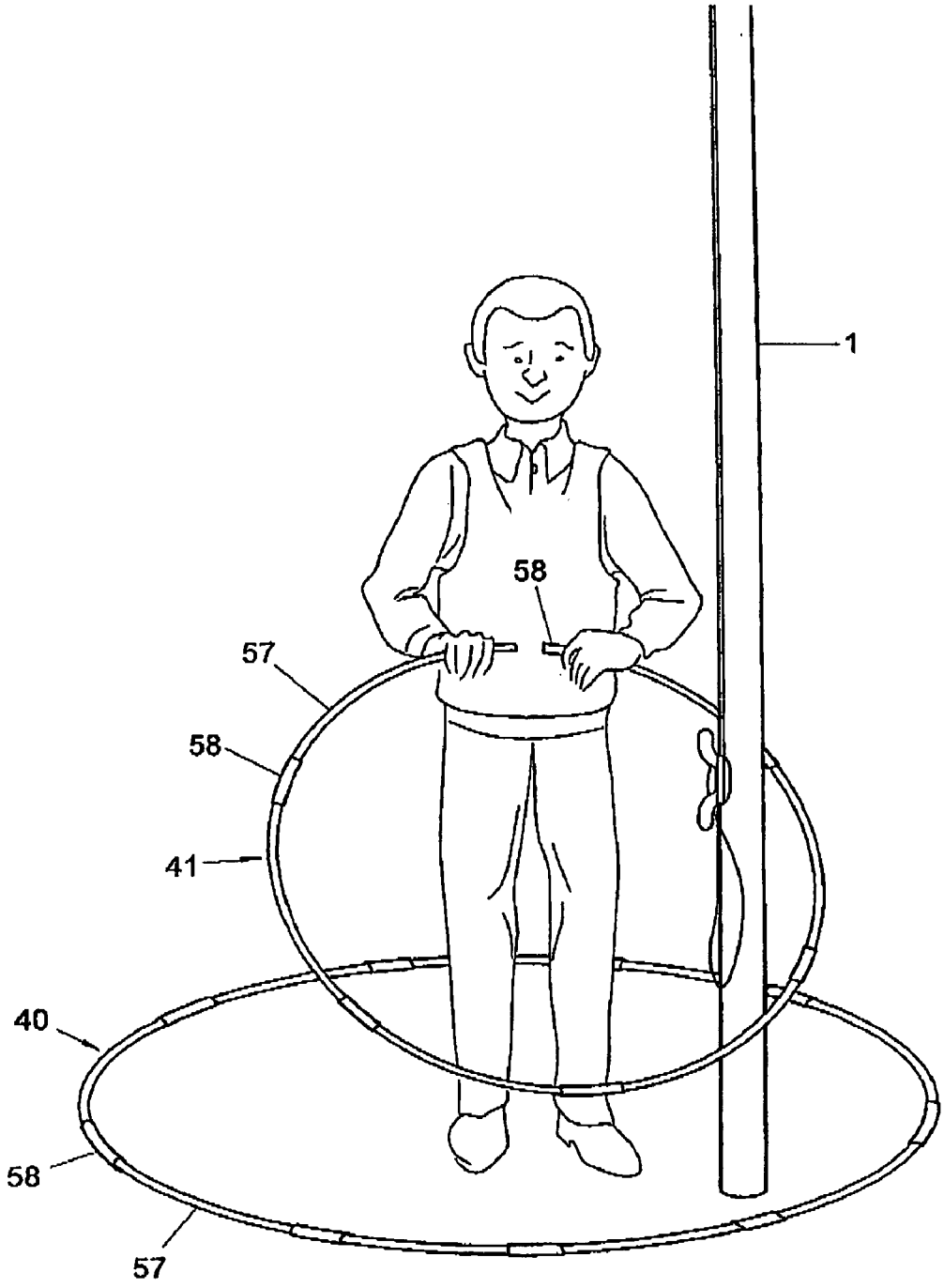
FIG. 13 shows a first phase of the set-up of the exemplary embodiment represented in FIG. 12.
Figure 17:
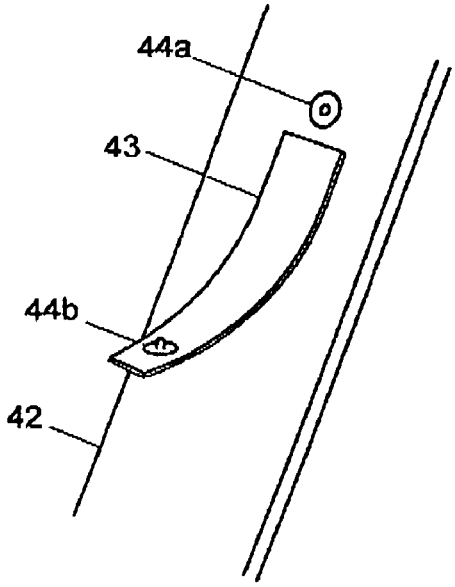
FIGS. 17 and 18 show a connecting element with a loop to be opened and closed with a press-stud.
Figure 18:
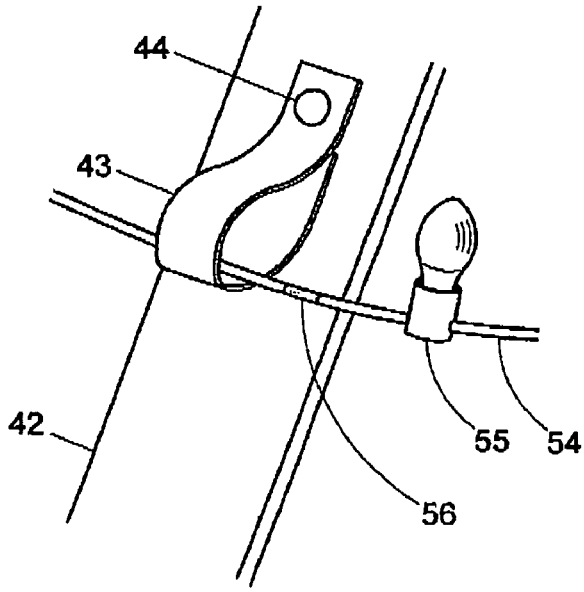

The exemplary embodiment is provided with two peripheral elements 40, 41. The peripheral elements 40, 41 are designed as the known, foldable tent poles consisting of several hollow, bendable, flexible rod parts 57 which are mutually connected with the aid of sleeves 58, while an elastic band extending in the interior of the rods 57 pulls the rods 57 into the sleeves (see FIG. 13). The rod parts 57 may be manufactured from a fiber material or a carbon composite. Further are provided six connecting elements 42 from band material, extending obliquely upwards. As is clearly represented in FIGS. 17 and 18, on these connecting elements 42, loops 43 are provided which can be opened and closed with the aid of a press stud closure.

Only the lower ring 40 is centered relative to the flagpole 1 by a fastening assembly also manufactured from band material.

Figure 15:
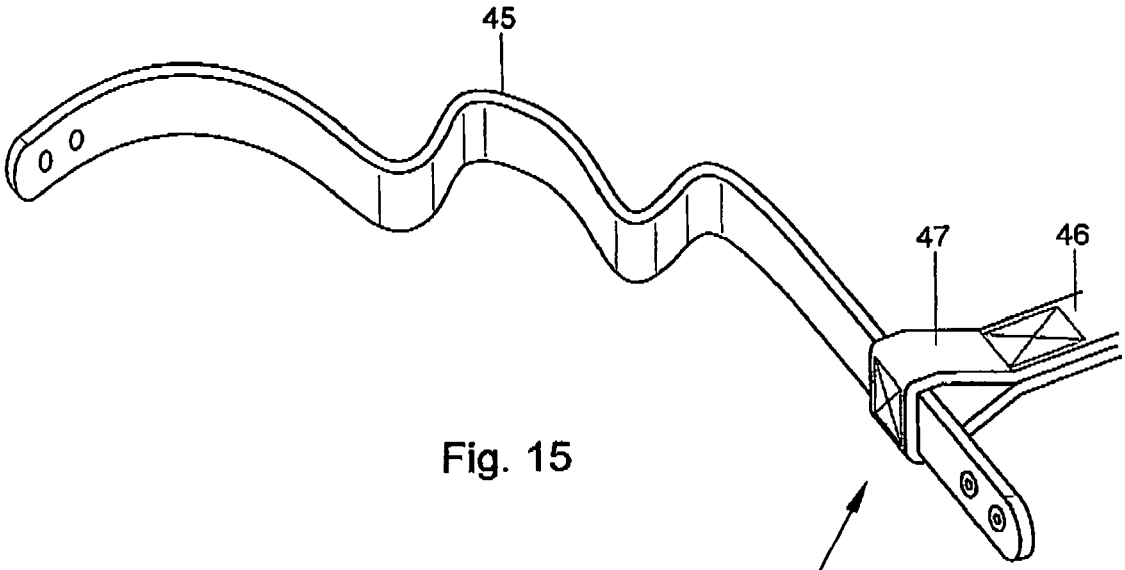
FIG. 15 shows a central band in a condition not yet fitted.
Figure 16:
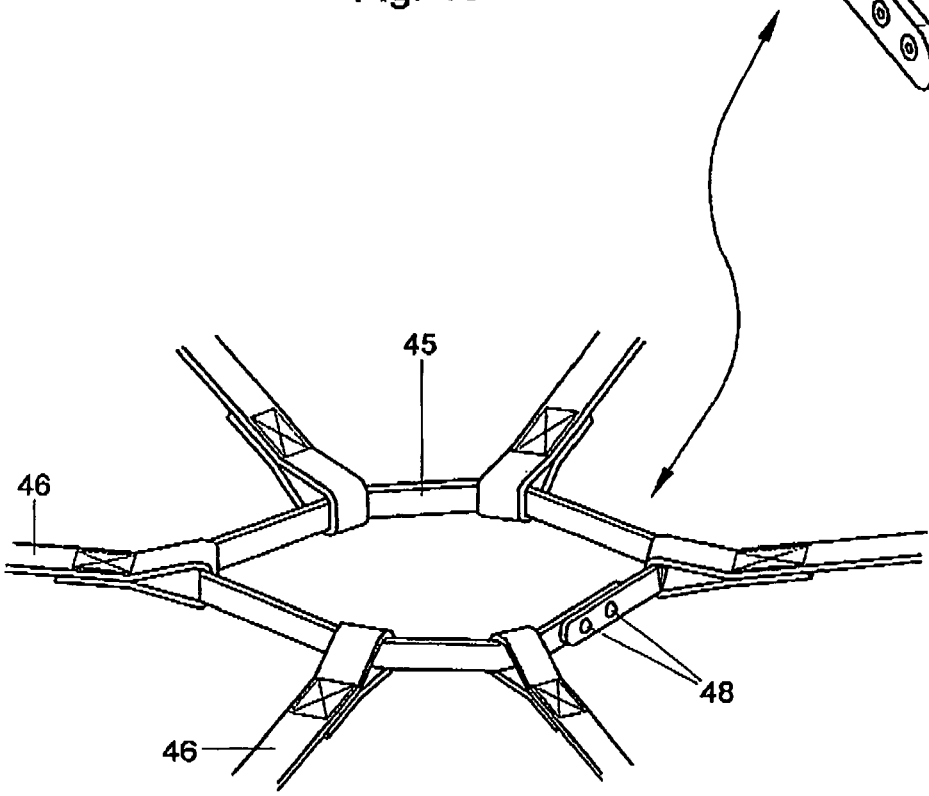
FIG. 16 shows this central band of FIG. 15 in fitted condition.
Figure 19:
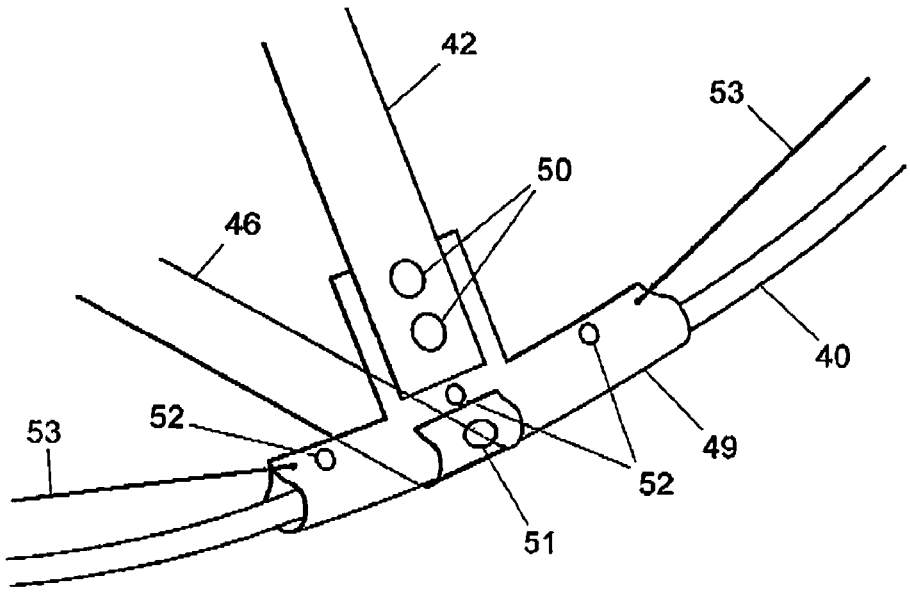
FIG. 19 shows a bush around a peripheral element with a connecting element and radial band connected thereto.

As is clearly shown in FIGS. 15 and 16, the fastening assembly comprises a central ring band 45 and a number of radial bands 46 to be subjected to tensile stress. On an end facing the central ring band 45, the radial bands 46 are provided with a loop 47. The loops 47 of the six radial bands 46 are slid over the central ring band 45 and then the central ring band 45, which is provided with press studs 48 for opening and closing the central ring band 45, is arranged around the mast 1 and closed with the aid of the press studs. On the ends facing the lower peripheral element 40, the radial bands 46 are connected to bushes 49 with the mast dressing in fitted condition. In FIG. 19, this bush 49 is represented in more detail. The bush 49 shown can be connected with press studs 50 to the bands 42 reaching obliquely upwards and forming the connecting elements 42. With the aid of press stud 51, the radial band 46 can be connected to the bush 49. Further, the bush 49 itself is provided with press stud closures 52 with the aid of which the bush can be opened so that it can be provided around the peripheral element 40 in a simple manner. The six bushes 49 that are provided on the peripheral element 40 can be mutually connected by means of elastic band 53. The elastic bands 53 ensure that the bushes are provided in a uniformly distributed manner on the peripheral element 40 and maintain their position there, also in windy conditions.

In the exemplary embodiment of FIG. 12, each time between two neighbouring connecting elements 42, a strand of lights 54 with lights 55 is suspended in a zigzag manner, while the zigzag parts that extend, each time, between two connecting elements, preferably sag to some extent in a catenary curve. Preferably, between two fastening points located one above the other on a connecting element 42 of a first strand of lights 54, there is, each time, a fastening point of a neighbouring strand of lights 54. The points of the one zigzag strand of lights 54 then extend, as it were, between the points of the neighbouring zigzag strand of lights 54. Owing to this zigzag suspension, a Christmas tree branch-shape of lights is suggested in a natural manner, which contributes to an exceeding extent to the aesthetic effect of this embodiment. The strand of lights 54 is fitted with the aid of the loops 43 shown in FIGS. 17 and 18. In order to aid the user when fitting in a correct manner, a strand of lights 54 between two neighbouring connecting elements 42, the strand of lights is provided with marking 56 at the location where the strand of lights 54 is to be received in a loop 42. It is also possible that each time, one light 55 that is to be located in front of or behind a loop 42, is provided with a colour marking. Due to the presence of the marking 56, the user can straightaway fit the strand of lights 54 in the proper manner, whereby the correct degree of sagging of the strand of lights 54 between the successive loops 42 is obtained and, hence, the Christmas tree branch appearance is optimally suggested. In the present exemplary embodiment, the device is provided with six strands of lights 54 of which only one is shown in FIG. 12.

A comparable effect can naturally also be achieved in a different manner, for instance by winding two or more strands of lights 54 in opposite directions around the connecting elements, the strands of lights 54 preferably also being secured to the connecting elements 42, preferably there where they intersect. It is then preferred that the parts of the strands of lights extending between successive connecting elements slightly sag, as described hereinabove, so that the shape of lights the Christmas tree branch is suggested. Variations hereon through, for instance, a combination of winding and zigzag configuration of strands of lights, naturally also fall within the description.

During fitting, preferably, first the peripheral element 40 and 41 are provided around the flagpole 1, as shown in FIG.

13. To that end, the rods 57 and the sleeves 58 are placed one into the other and the two foldable rod assemblies are formed into two peripheral elements 40, 41 closed upon themselves.

Figure 14:
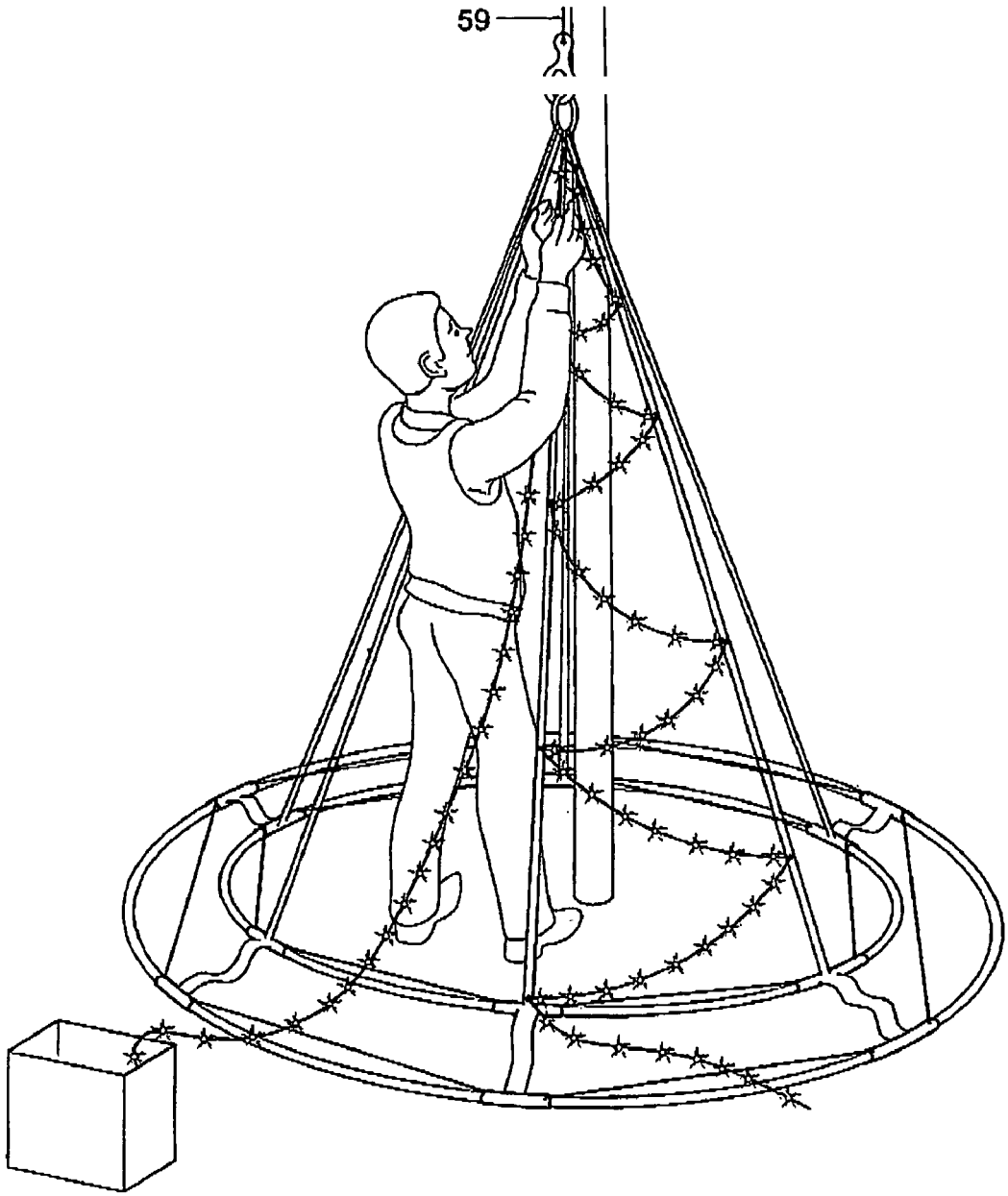
FIG. 14 shows a second phase of the set-up of the exemplary embodiment represented in FIG. 12 of an embodiment of a dressing device that is to form a Christmas tree like decoration on a flagpole.

Then, FIG. 14 shows that the bushes 49 are provided around the rings 40, 41 and that the connecting elements 42 designed in band are connected to the bushes 49. Then, the top of the device is connected with the hoisting rope 59 of the mast 1 and partly hoisted so that the top of the device can still be reached from the ground by a person. Thereupon, the six strands of lights 54 are connected to the connecting elements 42 by means of the loops 43. Use is then made of the marking 56 for connecting the strands of lights 54 at the correct location with the loops 43 to the connecting elements 42, so that the zigzag configuration mentioned hereinabove and shown in FIGS. 12 and 14 is obtained. When the top end of the six strands of lights 54 is fitted, the device can be hoisted further upwards, so that a subsequent portion of the strands of lights 54 can be fitted. During or after the above-described fitting operations, or directly after the provision of the bushes 49 to the bottom peripheral element 40, the fastening assembly 45, 46 for centring the peripheral element 40 with respect to the mast 1 can be provided.

In the completely hoisted condition, the exemplary embodiment shown has a height of six meters. It is clear that other dimensions too are possible. During the above-described fitting operation or directly after forming the first peripheral element 40, the fastening assembly 45, 46 for centring the peripheral element with respect to the mast 1 can be provided.

It will be clear that the dressing device 9 in each form that is shown or desired can be presented separately and be furnished for use with existing masts such as flagpoles, for instance if the dressing device is only used temporarily, for instance as Christmas illumination or decoration. However, a mast 1 can also be specially provided for forming an assembly according to the invention.

The invention is not limited in any manner to the exemplary embodiments described and shown. Many variations thereon are possible within the framework of the invention as outlined by the claims.

For instance, instead of relatively narrow band-shaped or wire-shaped connecting elements, also other connecting elements can be used, for instance a flexible dressing 17. This can be transparent as well as non-transparent. All sorts of suitable forms, types of illuminations and decorations can be used. The peripheral elements can have different forms and cross-sections and can be made from any desired material, for instance from plastic, wood or metal.

The invention claimed is:

1. A dressing device to be suspended in a mast for dressing the mast, the dressing device comprising:

at least two peripheral elements provided with bushes;

connecting elements manufactured from one of band material and cable material that connect the peripheral elements to each other;

means for suspending the dressing device from a top end of a mast;

loops that are provided on the connecting elements and that include press stud closures for opening and closing the loops, and strands of lights including lights and wiring interconnecting subsequent lights of a said strand of lights, at least one of the wiring and the lights being provided with markings indicating at which positions the strand of lights has to be connected to a connecting element by means of the loops, wherein each peripheral element comprises:

a number of hollow rods;

a number of sleeves; and an elastic band extending through the hollow rods and the sleeves and having a first end and a second end, wherein the peripheral element has a mounted state and a demounted state, wherein in the mounted state the rods are placed in associated sleeves and wherein said rod that is adjacent the first end is placed into a sleeve that is adjacent the second end so that a ring is formed in the mounted state and kept in that state by a pulling force of the elastic band and wherein in the demounted state the rods are detached from the sleeves so that the rods may be placed next and parallel to each other.

2. The assembly of claim 1, wherein between two neighboring connecting elements a strand of lights is suspended in a zigzag configuration.

3. The assembly of claim 1, wherein at least two strands of lights are wound in opposite directions around at least one part of the dressing device, such that the at least two strands of lights intersect.

4. The assembly according to claim 1, wherein at least a number of said peripheral elements are rings.

5. The assembly according to claim 1, wherein the dressing device is suspended from the mast to said cables or band elements in particular adjacent the top end of said mast.

6. The assembly according to claim 1, wherein the dressing device is hung over a guide, in the form of a pulley.

7. The assembly according to claim 1, wherein the peripheral elements are designed such that they fit together such that the dressing device can be folded up in a flat configuration and can be folded out to an elongated form.

8. The assembly according to claim 1, wherein decorative elements are provided on and/or in the dressing device.

9. The assembly according to claim 1, wherein the dressing device is substantially conical or pyramid-shaped, a narrow end of which being provided adjacent the top end of the mast.

10. The assembly according to claim 1, wherein a fastening element is provided for fastening the dressing device at a distance from said top part of the mast.

11. The assembly according to claim 1, wherein said fastening element is designed such that this allows at least partial rotation of the dressing device around the mast.

12. The dressing device according to claim 1, wherein the device is provided with a fastening assembly for centering at least one peripheral element, the fastening assembly being manufactured from band material.

13. The dressing device according to claim 1, wherein the fastening assembly comprises a central ring band and a number of radial bands, the central ring band being provided with a closure with which the ring band can be opened and closed for placement thereof around a mast.

14. The dressing device according to claim 12, wherein the fastening assembly is provided with a number of radial bands that, in a mounted condition are connected, at the ends located radially outwards, to bushes that, in a mounted condition are being provided around a lower one of the at least two peripheral elements.

15. The dressing device according to claim 1, wherein the bushes are each also connectable to a said connecting element, preferably with a press stud closure.

16. The dressing device according to claim 1, wherein the connecting elements are connectable to bushes that, in a mounted condition are provided over the peripheral elements.

17. The dressing device according to claim 1, wherein each part of a said strand of lights which extends between two neighboring connecting elements slightly sags in a catenary curve.

18. A method for dressing a mast including:

providing a mast;

providing a dressing device;

hoisting the dressing device into the mast such that at least two peripheral elements mutually connected by the connecting elements are located in vertically spaced relationship relative to each other; and connecting at least one strand of lights to the connecting elements by means of the loops with the press stud closures using the markings on the strand of lights for determining correct connecting positions while intermittently hoisting the dressing device into the mast wherein the at least two peripheral elements of the dressing device each include:

a number of hollow rods;

a number of sleeves; and an elastic band extending through the hollow rods and the sleeves and having a first end and a second end, wherein the peripheral element has a mounted state and a demounted state, wherein in the mounted state the rods are placed in associated sleeves and wherein a said rod that is adjacent the first end is placed into a sleeve that is adjacent the second end so that a ring is formed in the mounted state and kept in that state by a pulling force of the elastic band and wherein in the demounted state the rods are detached from the sleeves so that the rods may be placed next and parallel to each other: and wherein the dressing device includes:

a fastening assembly for centering at least one peripheral element, the fastening assembly being manufactured from band material and including a central ring band and a number of radial bands, the central ring band being provided with a closure with which the ring band can be opened and closed for placement thereof around a mast;

wherein the method includes:

bringing the peripheral elements from the demounted state in the mounted state extending around the mast;

connecting the connecting elements to the peripheral elements;

fitting between at least two neighboring connecting elements a strand of lights in a zigzag configuration while intermittently the device hoisted somewhat higher into the mast; and connecting the fastening assembly to at least a lower one of the peripheral elements for centering the lower one of the peripheral elements relative to the mast.

19. A dressing device to be suspended in a mast for dressing the mast, the dressing device comprising:

at least two peripheral elements provided with bushes;

connecting elements manufactured from one of band material and cable material that connect the peripheral elements to each other;

means for suspending the dressing device from a top end of a mast;

loops that are provided on the connecting elements and that include press stud closures for opening and closing the loops, and strands of lights including lights and wiring interconnecting subsequent lights of a said strand of lights, at least one of the wiring and the lights being provided with markings indicating at which positions the strand of lights has to be connected to a connecting element by means of the loops, wherein the bushes which are placed on a peripheral element are interconnected by elastic bands of substantially equal lengths, such that the bushes are held positioned in a uniformly distributed manner on the peripheral element.

20. A dressing device to be suspended in a mast for dressing the mast, the dressing device comprising:

at least two peripheral elements provided with bushes;

connecting elements manufactured from one of band material and cable material that connect the peripheral elements to each other;

means for suspending the dressing device from a top end of a mast;

loops that are provided on the connecting elements and that include press stud closures for opening and closing the loops, and strands of lights including lights and wiring interconnecting subsequent lights of a said strand of lights, at least one of the wiring and the lights being provided with markings indicating at which positions the strand of lights has to be connected to a connecting element by means of the loops, wherein the bushes are provided with press stud closures with the aid of which the bush can be opened, so that it can be provided around a peripheral element.

* * * * *